US007624470B2

(12) United States Patent
Heyman

(10) Patent No.: US 7,624,470 B2
(45) Date of Patent: Dec. 1, 2009

(54) HEAT EXCHANGE COIL CLEANING APPARATUS

(76) Inventor: Keith A. Heyman, 962 Sunrise Hwy., West Babylon, NY (US) 11704

( * ) Notice: Subject to any disclaimer, the term of this patent is extended or adjusted under 35 U.S.C. 154(b) by 882 days.

(21) Appl. No.: 10/919,857

(22) Filed: Aug. 17, 2004

(65) Prior Publication Data

US 2006/0037736 A1 Feb. 23, 2006

(51) Int. Cl.
*A47L 5/00* (2006.01)

(52) U.S. Cl. ..... 15/301; 15/302; 15/312.1; 15/312.2; 15/314; 15/318; 15/318.1; 15/345

(58) Field of Classification Search ..... 15/301, 15/302, 312.1, 312.2, 314, 318, 318.1, 345, 15/346; *A47L 5/00, 9/00*
See application file for complete search history.

(56) References Cited

U.S. PATENT DOCUMENTS 2,660,410 A * 11/1953 Hofmeister ..... 165/163
2,696,631 A * 12/1954 Hibner ..... 15/317
4,421,067 A * 12/1983 Krowech ..... 122/390
4,470,833 A 9/1984 Wolfe
5,579,726 A * 12/1996 Finucane ..... 122/379
5,875,833 A * 3/1999 Schluter ..... 165/5
6,571,420 B1 * 6/2003 Healy et al. ..... 15/301

* cited by examiner

*Primary Examiner*—David A Redding
(74) *Attorney, Agent, or Firm*—Tutunjian & Bitetto, P.C.

(57) ABSTRACT

A cleaning apparatus for cleaning a heat exchange coil includes a gas-dispensing member having a cavity for carrying a gas and at least one orifice in communication with the cavity. An actuating device which couples to the gas dispensing member and moves the gas dispensing member relative to a coil such that the gas dispensed from the gas dispensing member through the at least one orifice removes dust and debris from the coil. A timer initiates operation of the gas-dispensing member and the actuating device at given time intervals.

27 Claims, 8 Drawing Sheets

HEAT EXCHANGE COIL CLEANING APPARATUS

BACKGROUND OF THE INVENTION

1. Field of the Invention

The present invention relates to automated devices, and more particularly to an apparatus for automatically cleaning a coil for air conditioning and refrigeration systems.

2. Description of the Related Art

Coils for air conditioning units and refrigeration units or cooling units often collect dust and debris by virtue of their operation. These types of units often suffer from placement in poorly ventilated areas as well. As a result, the debris and dust builds up on the surface of the coil. This build up reduces the efficiency and operation of the air condition and refrigeration units.

The cooling units therefore require maintenance to clean them. This maintenance usually requires a heating ventilation and air conditioning (HVAC) professional to make a site visit in order to clean the coils. This may add a significant expense to the maintenance budget, for say a restaurant of other establishment.

Therefore, a need exists for an apparatus and method for cleaning coils for cooling units, which does not require a site visit and maintains the coils in a clean state to improve operational efficiency.

SUMMARY OF THE INVENTION

A cleaning apparatus for cleaning a heat exchange coil includes a gas-dispensing member having a cavity for carrying a gas and at least one orifice in communication with the cavity. An actuating device which couples to the gas dispensing member and moves the gas dispensing member relative to a coil such that the gas dispensed from the gas dispensing member through the at least one orifice removes dust and debris from the coil. A timer initiates operation of the gas-dispensing member and the actuating device at given time intervals.

A cleaning apparatus for cleaning a heat exchange coil includes a gas-dispensing member having a cavity for carrying a gas and at least one orifice in communication with the cavity. An actuating device couples to the gas dispensing member and moves the gas dispensing member relative to a coil such that the gas dispensed from the gas dispensing member through the at least one orifice removes dust and debris from the coil. A dust and debris collecting device collects the dust and debris removed from the coil. A timer initiates operation of the gas-dispensing member, the collecting device and the actuating device at given time intervals.

In alternate embodiments, the gas-dispensing member may include a tube having an adjustable length. The gas-dispensing member may communicate with a regulator, which controls a pressure of dispensed gas. A flexible tube may be included for connecting the regulator output to the gas-dispensing device. The gas-dispensing member may include a tube having a shape, which bounds a perimeter of the coil. The dispensing member may include a tube having portions, which are coplanar and parallel.

In still other embodiments, at least one solenoid controls gas flow between the gas dispensing member and a supply. The actuating device may include at least one pneumatic cylinder. The actuating device and the gas-dispensing member may share a gas supply. A contact switch may be mounted on the gas-dispensing member, which reactivates the timer when the gas-dispensing member reaches a position.

The collecting device may include a dust collecting material disposed on an opposite side of the coil from the gas-dispensing member. The collecting device may include an irrigation system for maintaining the dust collecting material in a wet state. The collecting device may include a suction tube disposed on an opposite side of the coil from the gas-dispensing member. The collecting device may include orifices directed in a plurality of different directions.

These and other objects, features and advantages of the present invention will become apparent from the following detailed description of illustrative embodiments thereof, which is to be read in connection with the accompanying drawings.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

The present invention provides an apparatus for automatically cleaning a coil, such as a condenser coil, for a heat exchange unit. A heat exchange unit may include a cooling unit which in turn is used to refer to refrigerators, refrigeration units, air conditioning units, ice makers, cooling towers, or any other device where a coil or intricate pattern of materials are employed that would benefit from an intermittent cleaning program.

The present invention provides a tube or other hollow member that carries air or gas therein. The tube delivers the gas onto the coil to clear away dust and debris. The tube is connected to an actuating device, which moves the tube across the coils to deliver the gas at various locations on the coil. The gas is delivered intermittently by employing a timing device. When the timing device triggers the tube, gas in the tube is delivered to clean the coil while the tube moves across the coil. When the tube reaches a given position, the tube is reset until the timing device triggers the tube again.

The embodiments as illustratively set forth herein provide cleaning of coils without a visit by HVAC personal. In addition, coils are cleanly maintained to provide better efficiency of cooling units. It should be understood that the embodiments and aspects thereof can be combined in any way to provide additional advantages.

Figure 1:
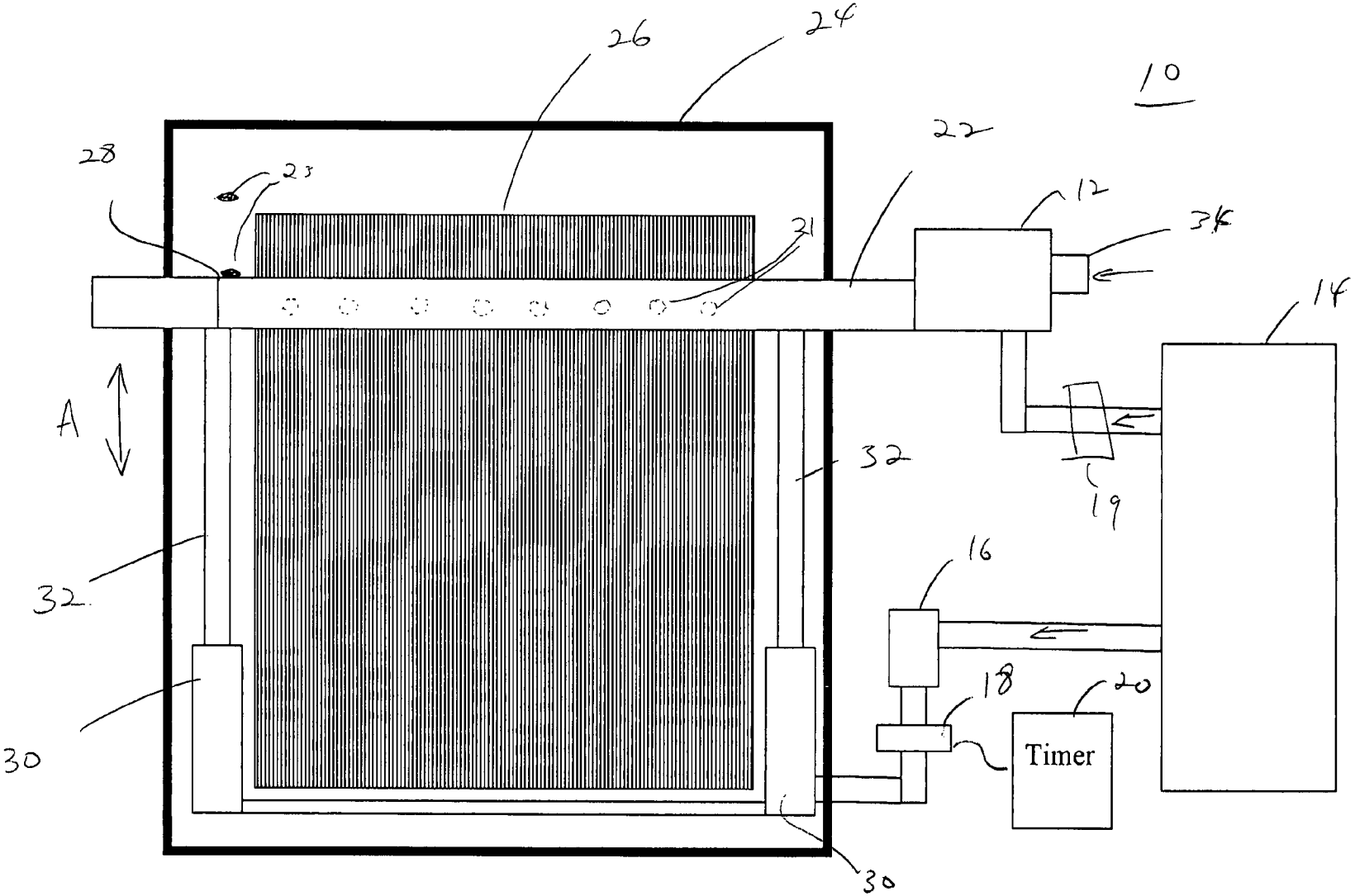
FIG. 1 is a schematic side view of a heat exchange coil cleaner in accordance with one embodiment of the present invention.

Referring now to the drawings in which like numerals represent the same or similar elements and initially to FIG. 1, a system 10 includes a regulator 12. Regulator 12 may include a regulator valve or other device, which controls the airflow into a tube 22. Air or other gas may be supplied by a compressor 14, tank or other pressurized container. The gas employed will be referred to herein as air; however any gas may be employed. In one embodiment, carbon dioxide is employed by using tanks used for carbonation of beverages for say, a soda fountain in a restaurant.

Tube 22 includes orifices 21 (shown in phantom lines), which deliver air onto a coil 26. Coil 26 includes a heat exchanger or radiator for dissipating heat from a cooling unit 24. Orifices 21 may include nozzles or other restrictions to assist in controlling airflow. Orifices 21 are preferably designed to provide a sufficient delivery pressure to clean coil 26 of dust and debris. The delivery pressure may be adjusted based on the conditions at hand and the application.

Tune 22 may include portions, such as telescoping portion or other adjustments 28 to permit an increase or decrease in overall length of tube 22. In this way, tube 22 is adaptable to different coils designs. In other embodiments, tube 22 may be adapted to a plurality of different shapes to, for example, surround round or rectangular coils to clean coils of different shapes.

Regulator 12 may include an adjustment 34, for example a valve or valve screw, to permit a user to may pressure adjustments for tube 22 during operation. Regulators are used to step up or down pressure as is know in the art.

Tube 22 is actuated in the direction of arrow "A" by actuating devices 32. Devices 32 preferably include pneumatic cylinders 30, but may include other mechanisms, such a screws, pulley systems, sprocket and chains, gears mechanisms, rodless cylinders or other actuating device that provides a steady slow motion, which conveys tube 22 along coil 26. These mechanisms are properly configured to ensure that coil 26 sees the cleaning action from gas delivered from tube 22. As such these actuating devices 30 provide full or limited motion suitable for carrying out the needed movement of tube 22. These designs would be understood by those skilled in the art.

In the embodiment shown, cylinders 30 receive air from compressor or tank 14 (which may be the same source or a different source from the supply for tube 22). An adjustable regulator 16 provides a given pressure to a solenoid 18, which is normally closed. When a timer 20 indicates to solenoid 18 that a predetermined time has elapsed, solenoid 18 is opened to pressurize cylinders 30 and actuate tube 22 upward. In addition, timer 20 may also control a solenoid 19 to permit airflow in tube 22. In one embodiment, airflow is controlled by a single solenoid (see e.g., solenoid 18 in FIG. 2), which supplies air to both tube 22 and cylinders 30. Other gating devices may be substituted for solenoids 18 or 19, for example, an electronically controlled valve or other gating or throttling device.

Timer 20 may trigger the cleaning process at regular intervals such as 1-2 times a day or any other preset amount of time. Timer 20 may be set to work continuously or be programmed to run a program which can control, e.g., the number or passes the duration of the pass, the amount of time for the operation, the speed of the tube or any other variable. Timer 20 preferably includes a semiconductor chip having a processor, a clock mechanism, a memory and a user interface for programming timer 20. The user interface may include a display, control knobs/switches and/or a speaker.

In alternate embodiments, timer 20 may include a simple clock device and a switch, which may be embodied on a semiconductor chip (solid state clock and switch) or in mechanical hardware (e.g., solenoid switch). Timer 20 may be or include a wireless device or a wired device. Using a wireless timing device may enable using a single timer 20 to control a plurality of systems 10 at a single or even a multiple locations. Timer 20 may include a programmable device, which controls the motion provided by actuating devices 32.

For example, a trigger signal may remain on until tube 22 reaches a highest position. Contacts 23 may be employed to provide feedback on a position of tube 22. In one embodiment, when contacts or switch 23 touch, the trigger signal is terminated and solenoid 18 is closed allowing tube 22 to return to its initial position. Solenoid 19 may still be permitted to be open to permit tube 22 to clean coil 26 on its return to its initial position.

Figure 2:
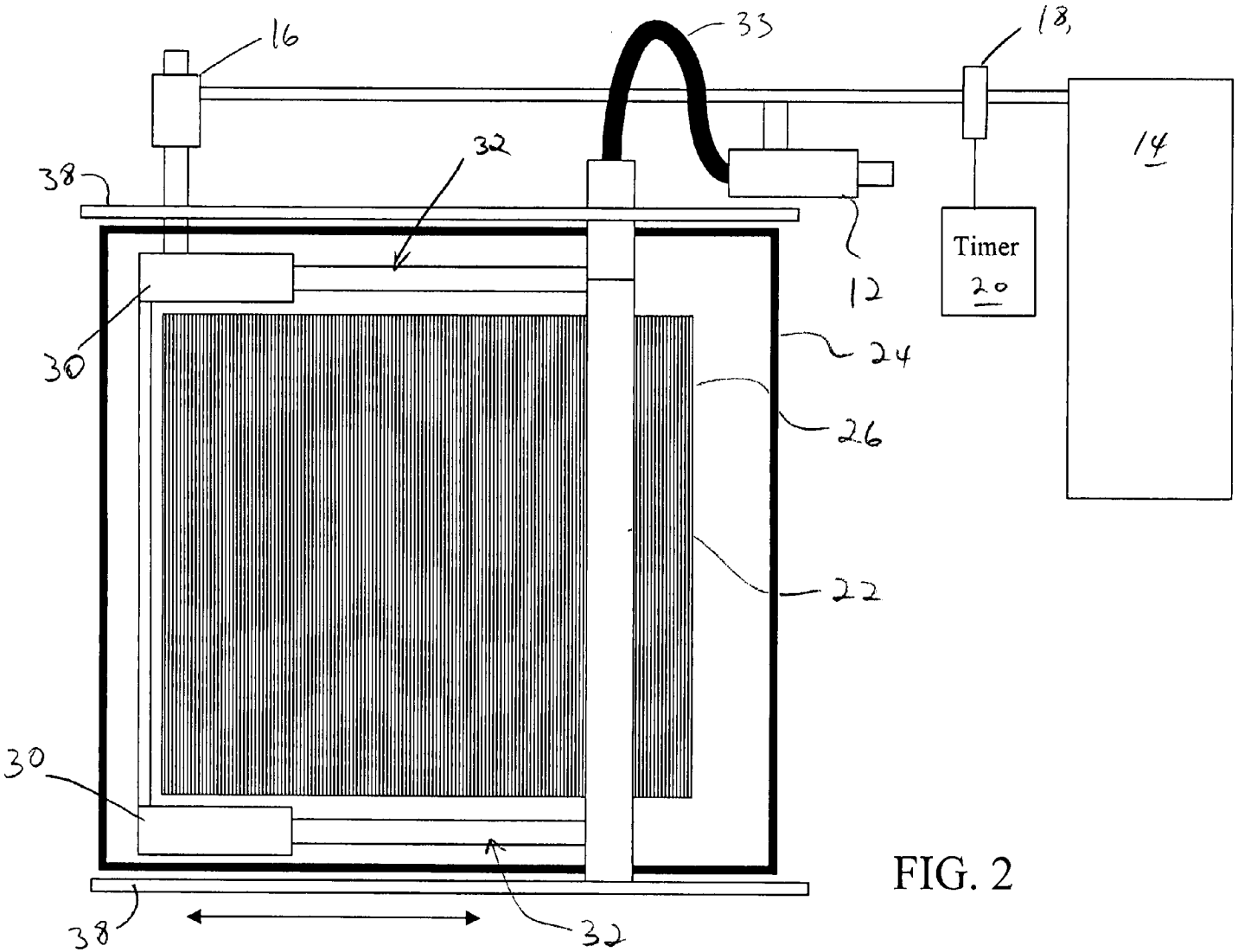
FIG. 2 is a schematic side view of a heat exchange coil cleaner which includes a flexible tube connecting a regulator to a gas dispensing member or tube and including a track for guiding the tube in accordance with one embodiment of the present invention.

Referring to FIG. 2, a system 100 shows a vertically oriented tube 22 for an alternate embodiment of the present invention. System 100 includes a flexible supply tube 33, which permits tube 22 to move independently of regulator 12. Tube 22 may ride in a slot or other constraint formed in a portion of unit 24. However, in other embodiments, a track 38 or other guide system may be employed to constrict the sideways motion of tube 22 and ensure that tube 22 maintains a desired spacing from coil 26 (e.g., the spacing between coil 26 and tube 22 into the page of FIG. 2. Track 38 and flexible tube 33 may be employed in embodiments where tube 22 is horizontally disposed as well.

Figure 3:
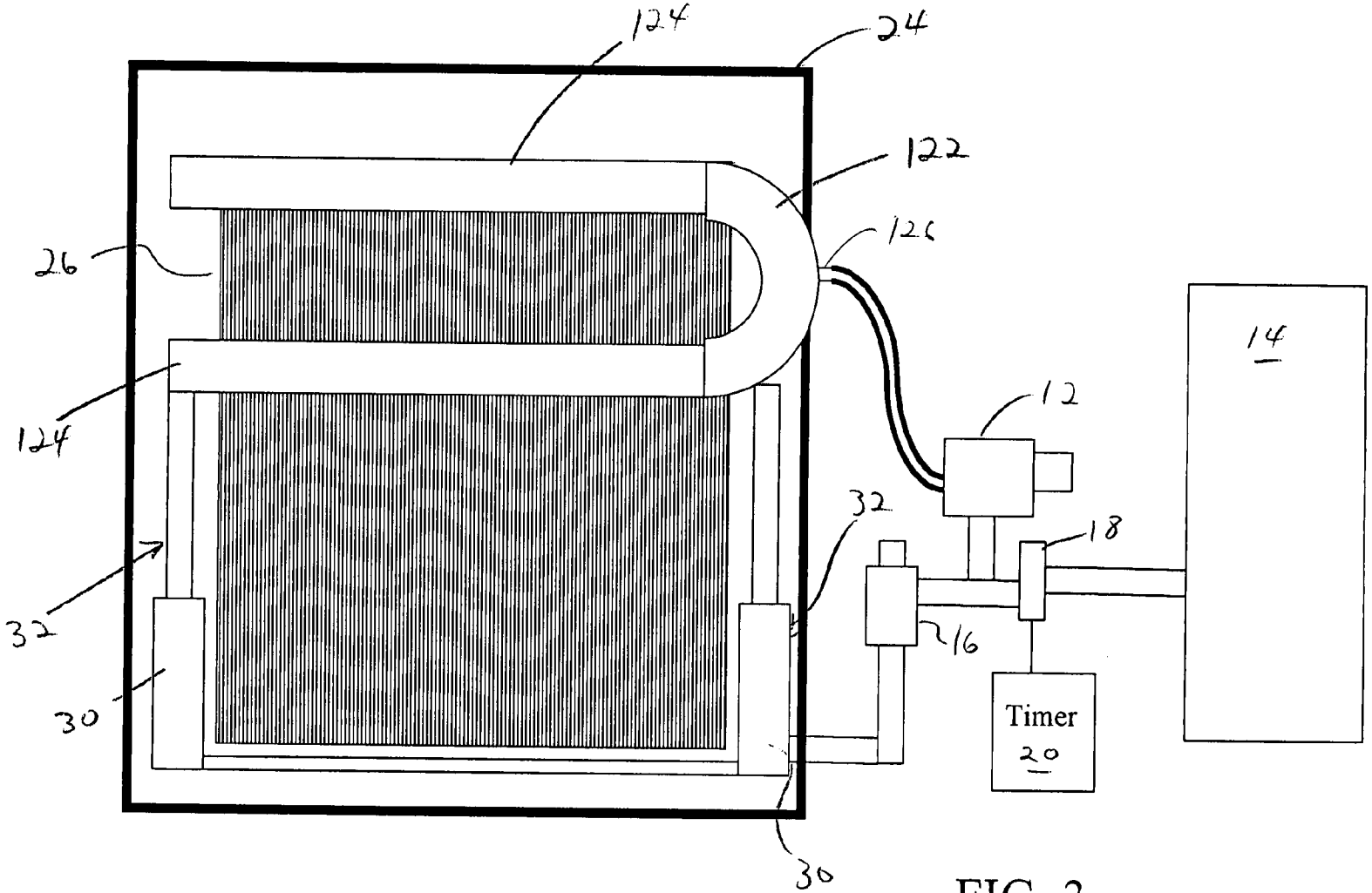
FIG. 3 is a schematic side view of a heat exchange coil cleaner having coplanar parallel tubes, which provide multiple cleaning orifices in a single pass in accordance with one embodiment of the present invention.

Referring to FIG. 3, a tube 122 may include a plurality of shapes. In the embodiment shown, tube 122 passes across coil 26 two times in a single pass by employing a double tube arrangement. This embodiment is particularly useful when vertically arranged. Tubes 124 may be made symmetrical and only a single inlet connection 126 is needed.

Figure 4B:
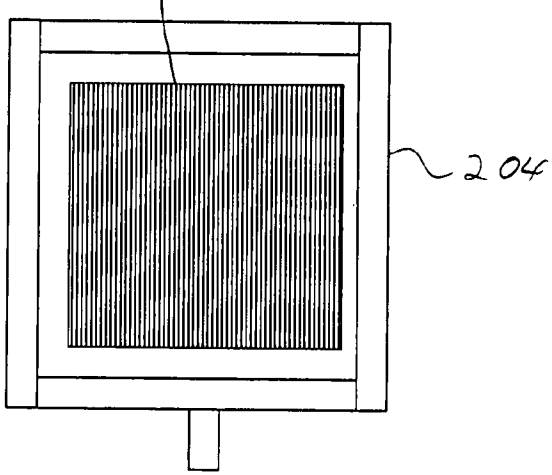
FIGS. 4A-4C show different gas dispensing member configurations in accordance with embodiments of the present invention.
Figure 4A:
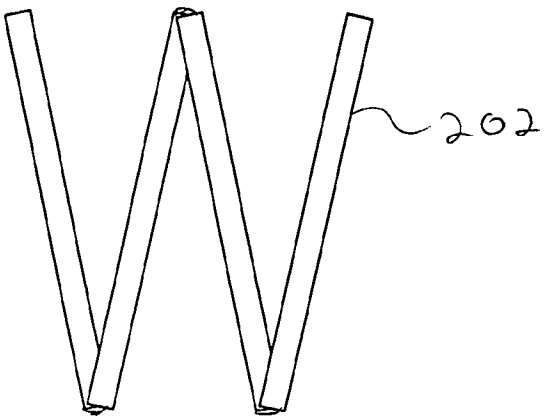
Figure 4C:
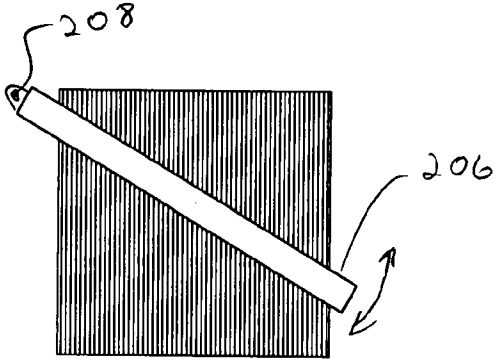

Referring to FIGS. 4A-4C, other tube arrangements are also contemplated in accordance with the present invention. Several arrangements are illustratively shown. FIG. 4A shows a multiple pass tube 202, which can be substituted for tube 22 or 122. In one embodiment, tube 202 or a similar arrangement may be employed without actuating devices or with actuating devices with limited movement, e.g., several inches instead on tens or inches. Tube 402 may remain stationary and delivery gas onto a coil in the same manner as tube 22 in all other aspects.

FIG. 4B shows a tube 204, which can be substituted for tube 22 or 122 for an air conditioning unit coil 26. Tube 204 can be made in a plurality of shapes and travel into and out of the page along coil 26 to clean coil 26 as described above. Circular or oval shaped tube arrangements are also contemplated.

FIG. 4C shows a tube 206, which pivots about a pivot point 208 and provides a wiping motion across coil 26. A single actuator (not shown) may be employed to rotate tube 206 about pivot point 208. In one embodiment, the length of tube 206 may also be adjusted to accommodate the shape of coil 26.

Dust and other debris may resettle on coils after cleaning them especially in poorly ventilated areas. The present invention may include measures for preventing the dust and debris from resettling on the coils.

Figure 5:
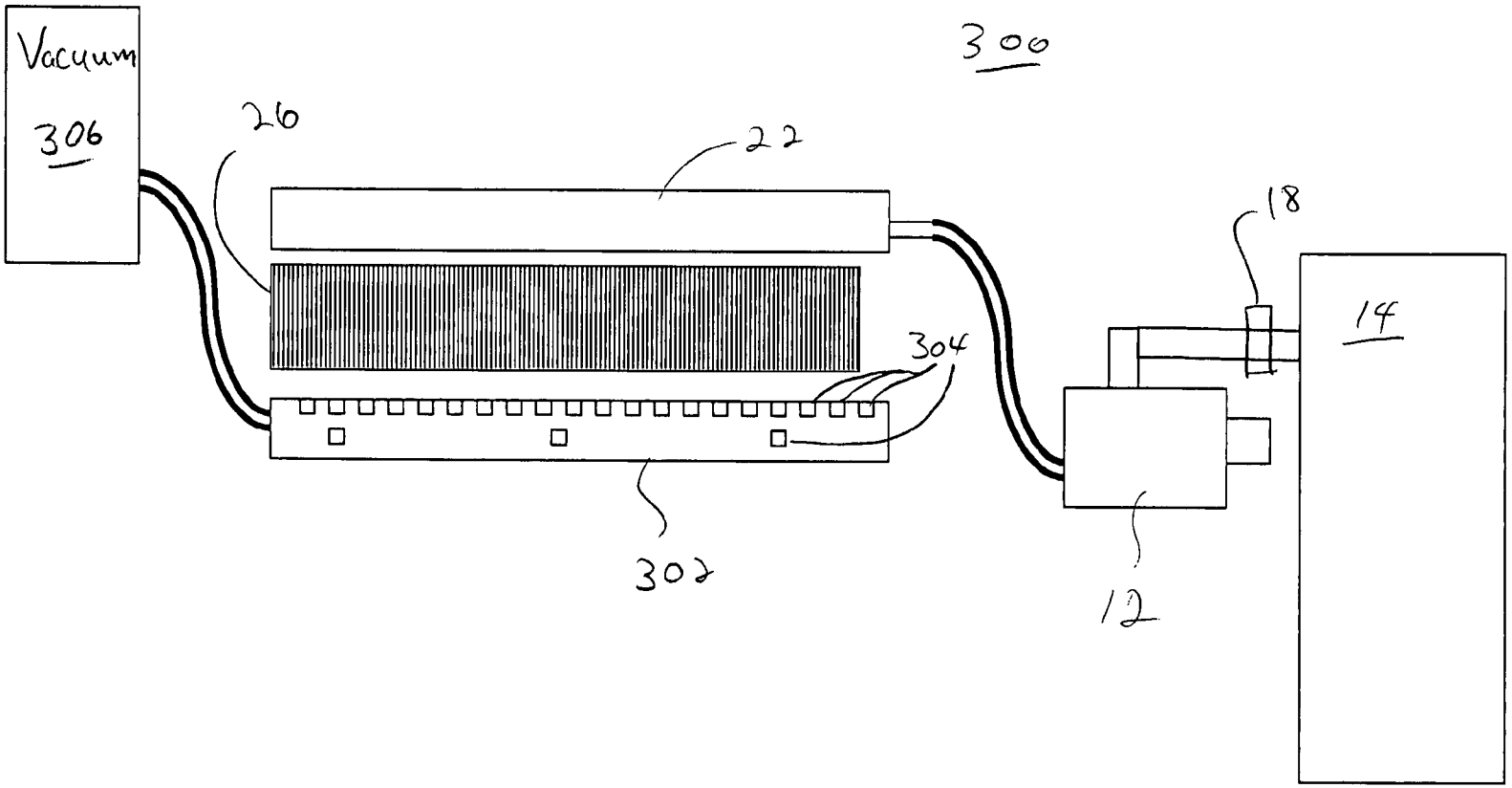
FIG. 5 is a schematic top view of a heat exchange coil cleaner having a suction tube for removing dust and debris from the area of the coil in accordance with one embodiment of the present invention.

Referring to FIG. 5, a system 300 includes, e.g. system 10 as described with reference to FIG. 1. In addition, a tube 302 includes orifices 304, which draw air and dust particles therein by employing suction or a vacuum 306. Orifices 304 may be directed toward coil 26 or in any direction. In this way, dust or debris may be collected from different places in the volume surround coil 26. Tube 302 preferably draws air concurrently while tube 22 delivers air. This cleans coil 26 while ensuring that at least a portion of the dust does not resettle on the coil 26. Depending on the design of the coil and the unit the coil is attached to, tube 302 may not be able to extend the whole length of coil 26. Instead, tube 302 may remain stationary or even have a limited travel distance and still effectively remove dust and debris from the area.

During operation, timer 20 (FIG. 1) initiates airflow in tube 22 and activates cylinders 30 to provide cleaning action. Timer 20 may also initiate operation of vacuum 306 as well. Vacuum 306 may also lag or precede operation of airflow in tube 22.

Tube 22 and 302 may be linked to enable one or more activating devices 32 to simultaneously move both tube 22 and 302. In this way, the amount of hardware is reduced so by reducing the number of devices 32 that are need to provide the desired motion of tubes 22 and 302.

Figure 6:
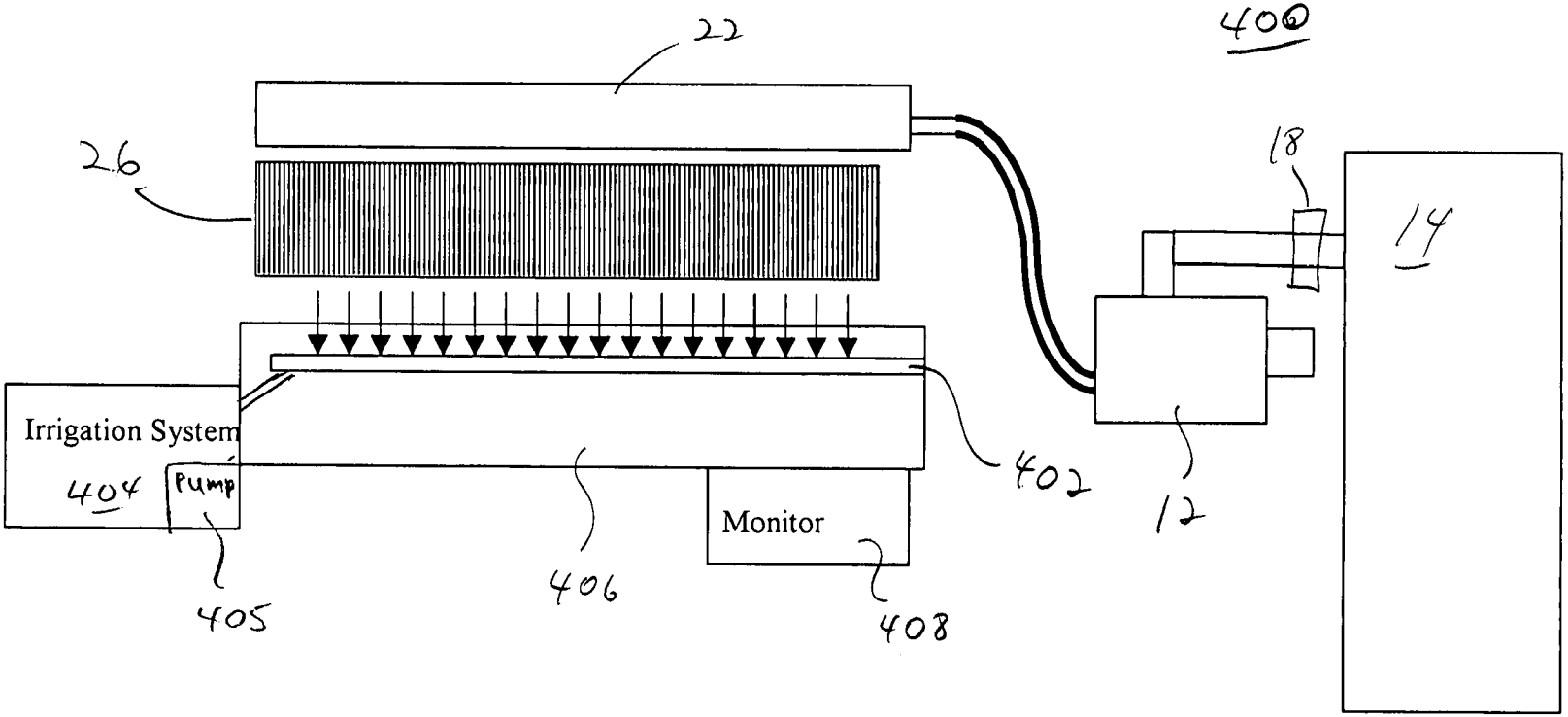
FIG. 6 is a schematic top view of a heat exchange coil cleaner having a dust/debris collecting material and an irrigation system for wetting the same in accordance with one embodiment of the present invention.

Referring to FIG. 6, a system 400 provides an alternate embodiment, which includes providing a dust/debris catching material 402. Material 402 is preferably maintained on an opposite side of coil from tube 22. Material 402 may include a fabric, filter material, sponge material or any other material suitable for trapping or catching dust and debris. An irrigation system 404 may be employed to maintain material 402 in a wet state to increase its effectiveness. Irrigation system 404 may include a pump 405 that circulates water in a reservoir 406. Water may be supplied from the unit that houses coil 26 (for example, in an ice mater or refrigerator with a water line). Reservoir 406 may include a water level monitor 408, which detects the water level and opens a valve if more water is needed. Pump 405 delivers water onto material 402 to maintain material in a wet state.

Wetting material 402 may be performed concurrently with the activation of airflow in tube 22 or may precede the activation of airflow. Material 402 may be replaced during routine maintenance of the system 400.

In one embodiment, roll filter may be employed for material 402, such as the one described by James C. Wolfe, in U.S. Pat. No. 4,470,833, incorporated herein by reference.

Figure 7:
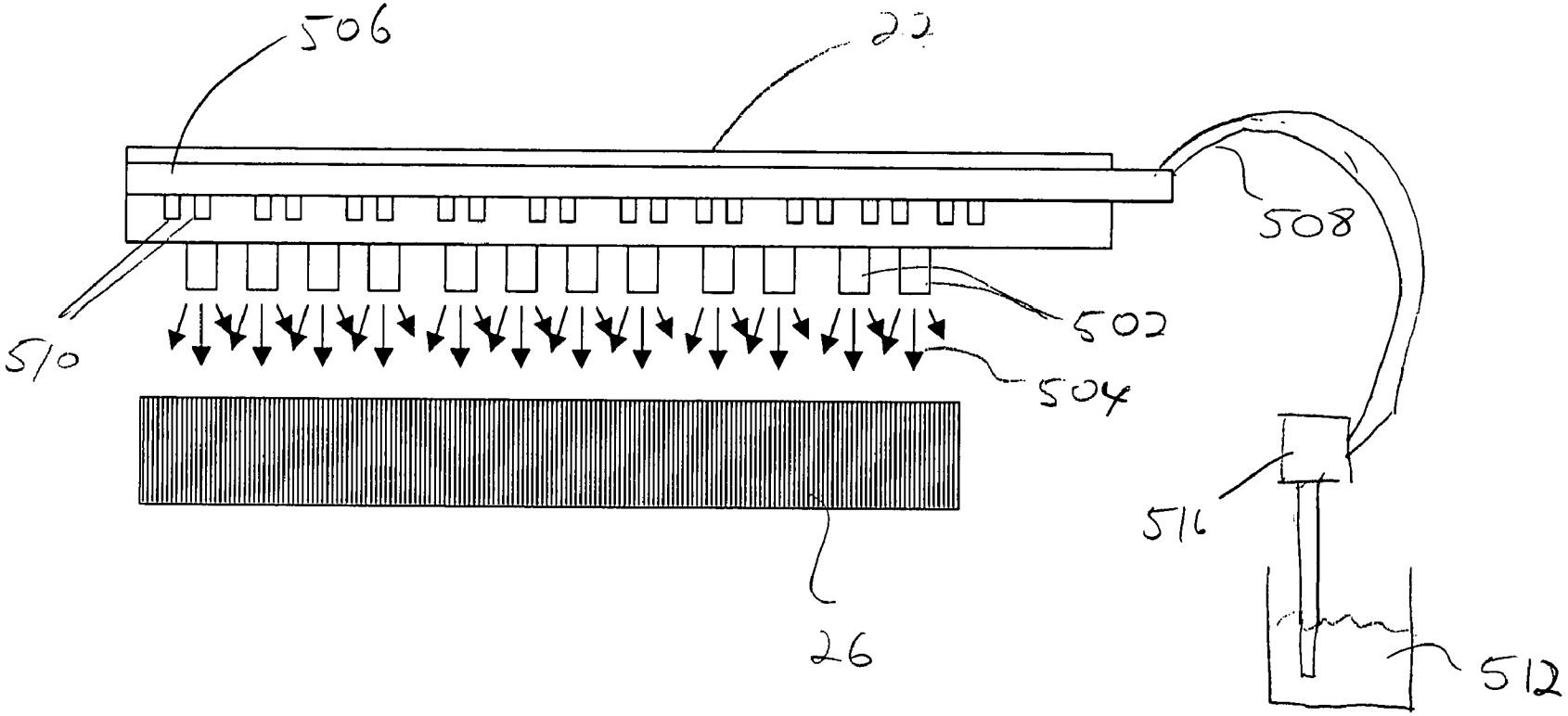
FIG. 7 is a schematic top view of a heat exchange coil cleaner showing nozzles and degrease dispenser on the gas dispensing device in accordance with one embodiment of the present invention.

Referring to FIG. 7, a tube 22 may include one or more nozzles 502. Nozzles 502 may be designed to provide a sufficient pressure in tube, direct air flow in a particular way or provide a desired flow pattern for air 504. Nozzles 502 may also be employed to mix gases or gas and liquids to be dispensed from tube 22.

In one embodiment, a separate tube 506 may include a feed line 508, which provides a liquid cleaner or cleaning agent 512, such as a degreaser to tube 506. The degreaser may be dispensed by employing the pressurized gas system used by tube 22, by delivering the degreaser into tube 22 for delivery or by employing a completely separate delivery system (e.g., pump 516) for delivering the liquid 512. Tube 506 may be connected to tube 22 and be actuated therewith so that degreasing can be performed over the entire coil 26 as was described for air cleaning herein above.

In one embodiment, air dispensing from tube 22 is performed at a different time from the dispensing of degreaser. For example, a gas clean is performed on a first pass of tube 22 followed be a degreasing operation in a subsequent pass. The subsequent pass may be hours later for example. The frequency of these operations may be altered and controlled by timer 20 (FIG. 1), on an as needed basis or according to a schedule, which may be programmed into timer 20.

Figure 8:
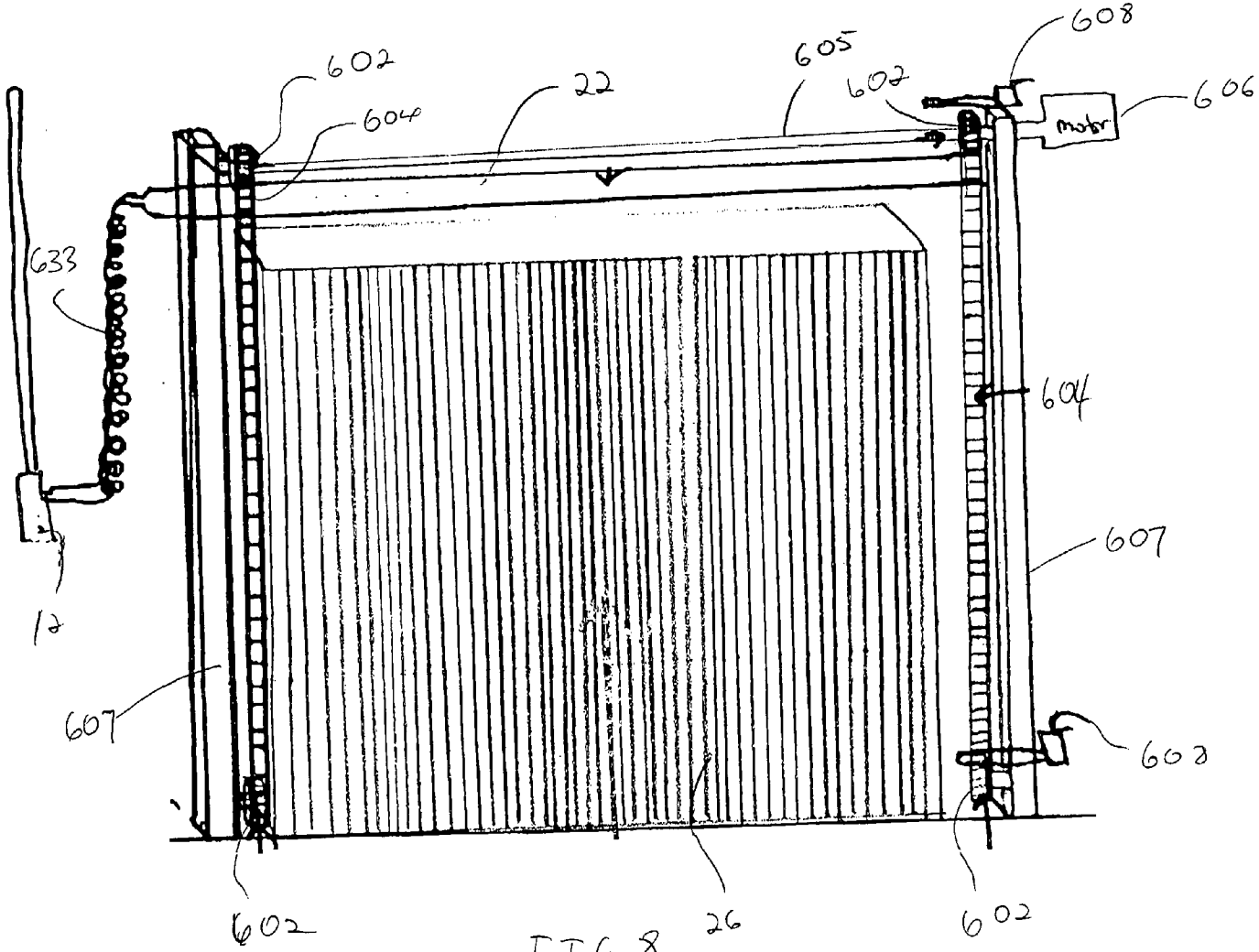
FIG. 8 is a schematic side view of a heat exchange coil using a sprocket and chain mechanism as an actuating device in accordance with one embodiment of the present invention.

Referring to FIG. 8, other embodiments of the present invention may employ different systems for actuating tube 22 in proximity of coil 26. In FIG. 8, tube 22 is mounted on a chain or chain 604 and the chains are operatively engaged with sprockets 602. Sprockets 602 are rotatably mounted on a frame 607. Frame 607 is connected to or mounted on the floor or unit in which the coil 26 is installed.

A motor 606 is activated by timer 20 (FIG. 1) to rotate a sprocket 606 (sprockets may connected through a common axle 605 or other linkage to ensure steady motion between sprockets 602). During rotation of sprockets 602, chains 604 move tube 22 along coil 26 to provide cleaning action as a result of gas flow through orifices or nozzles (not shown) formed in tube 22. Gas is supplied from a source through regulator 12 and coiled hose 633 to tube 22.

End switches or electric eyes 608 are provided to reverse motor 606 when tube 22 reaches the bottom or top of its travel distance relative to coil 26. Other mechanisms and combination thereof may also be employed in addition to or instead of the sprocket and chain mechanism shown in FIG. 8. For example, rodless cylinders may be employed to move tube 22 based on pneumatic pressure (similar to FIG. 1), gear trains, pulley systems or other mechanical linkages may also be employed.

Having described preferred embodiments of a coil cleaning device and method (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A cleaning system for cleaning a heat exchange coil, comprising a heat exchange coil;

a gas-dispensing member having a cavity for carrying a gas and at least one orifice in communication with the cavity, wherein the gas-dispensing member includes a tube having portions, which are coplanar and parallel;

an actuating device which couples to the gas dispensing member and moves the gas dispensing member relative to the coil such that the gas dispensed from the gas dispensing member through the at least one orifice removes dust and debris from the coil; and a timer which initiates operation of the gas dispensing member and the actuating device at given time intervals.

2. The system as recited in claim 1, wherein the gas-dispensing member includes a tube having an adjustable length.

3. The system as recited in claim 1, wherein the gas-dispensing member communicates with a regulator, which controls a pressure of, dispensed gas.

4. The system as recited in claim 3, further comprising a flexible tube connecting the regulator output to the gas-dispensing device.

5. The system as recited in claim 1, wherein the gas-dispensing member includes a tube having a shape which bounds a perimeter of the coil.

6. The system as recited in claim 1, further comprising at least one solenoid, which controls gas, flow between the gas dispensing member and a supply.

7. The system as recited in claim 1, wherein the actuating device and the gas-dispensing member share a gas supply.

8. The system as recited in claim 1, further comprising a contact switch mounted on the gas-dispensing member, which reactivates the timer when the gas-dispensing member reaches a position.

9. The system as recited in claim 1, further comprising an additional tube for dispensing cleaning agent onto the coil.

10. The apparatus as recited in claim 1, wherein the actuating device includes at least one pneumatic cylinder.

11. A cleaning system for cleaning a heat exchange coil, comprising a heat exchange coil;

a gas-dispensing member having a cavity for carrying a gas and at least one orifice in communication with the cavity;

an actuating device which couples to the gas dispensing member and moves the gas dispensing member relative to the coil such that the gas dispensed from the gas dispensing member through the at least one orifice removes dust and debris from the coil;

a dust and debris collecting device that collects the dust and debris removed from the coil; and a timer which initiates operation of the gas dispensing member, the collecting device and the actuating device at given time intervals.

12. The system as recited in claim 11, wherein the gas-dispensing member includes a tube having an adjustable length.

13. The system as recited in claim 11, wherein the gas-dispensing member includes a tube having a shape which bounds a perimeter of the coil.

14. The system as recited in claim 11, wherein the gas-dispensing member includes a tube having portions, which are coplanar and parallel.

15. The system as recited in claim 11, further comprising at least one solenoid, which controls gas, flow between the gas dispensing member and a supply.

16. The system as recited in claim 11, wherein the actuating device includes at least one pneumatic cylinder.

17. The system as recited in claim 16, wherein the actuating device and the gas-dispensing member share a gas supply.

18. The system as recited in claim 11, further comprising a contact switch mounted on the gas-dispensing member, which reactivates the timer when the gas-dispensing member reaches a position.

19. The system as recited in claim 11, wherein the collecting device includes a dust collecting material disposed on an opposite side of the coil from the gas-dispensing member.

20. The system as recited in claim 19, wherein the collecting device includes an irrigation system for maintaining the dust collecting material in a wet state.

21. The system as recited in claim 11, wherein the collecting device includes a suction tube disposed on an opposite side of the coil from the gas-dispensing member.

22. The system as recited in claim 21, wherein the collecting device includes orifices directed in a plurality of different directions.

23. The system as recited in claim 11, further comprising an additional tube for dispensing cleaning agent onto the coil.

24. The apparatus as recited in claim 11, wherein the gas-dispensing member communicates with a regulator, which controls a pressure of, dispensed gas.

25. The system as recited in claim 24, further comprising a flexible tube connecting the regulator output to the gas-dispensing device.

26. A cleaning apparatus for cleaning a heat exchange coil, comprising a gas-dispensing member having a cavity for carrying a gas and at least one orifice in communication with the cavity;

an actuating device which couples to the gas dispensing member and moves the gas dispensing member relative to a coil such that the gas dispensed from the gas dispensing member through the at least one orifice removes dust and debris from the coil;

a timer which initiates operation of the gas dispensing member and the actuating device at given time intervals; and a contact switch mounted on the gas-dispensing member, which reactivates the timer when the gas-dispensing member reaches a position.

27. A cleaning apparatus for cleaning a heat exchange coil, comprising a gas-dispensing member having a cavity for carrying a gas and at least one orifice in communication with the cavity;

an actuating device which couples to the gas dispensing member and moves the gas dispensing member relative to a coil such that the gas dispensed from the gas dispensing member through the at least one orifice removes dust and debris from the coil wherein the gas-dispensing member includes a tube having portions, which are coplanar and parallel; and a timer which initiates operation of the gas dispensing member and the actuating device at given time intervals.

* * * * *